US007220140B2

(12) United States Patent
Nagano et al.

(10) Patent No.: US 7,220,140 B2
(45) Date of Patent: May 22, 2007

(54) BOARD CONNECTOR

(75) Inventors: Hiroyuki Nagano, Osaka (JP); Toshihito Kusakabe, Osaka (JP)

(73) Assignee: Hosiden Corporation, Yao-shi, Osaka (JP)

( * ) Notice: Subject to any disclaimer, the term of this patent is extended or adjusted under 35 U.S.C. 154(b) by 0 days.

(21) Appl. No.: 11/367,365

(22) Filed: Mar. 6, 2006

(65) Prior Publication Data

US 2007/0087607 A1 Apr. 19, 2007

(30) Foreign Application Priority Data

Oct. 17, 2005 (JP) ..... 2005-301581

(51) Int. Cl.
*H01R 13/28* (2006.01)
*H01R 25/00* (2006.01)

(52) U.S. Cl. ..... 439/288

(58) Field of Classification Search ..... 439/284, 439/285, 286, 287, 288, 367, 326, 65, 66
See application file for complete search history.

(56) References Cited

U.S. PATENT DOCUMENTS 6,162,081 A * 12/2000 Commerci et al. ..... 439/287
6,629,849 B2 * 10/2003 Yu ..... 439/74
6,666,703 B2 * 12/2003 Takeuchi ..... 439/342
6,780,049 B1 * 8/2004 D'Angelo et al. ..... 439/537
6,857,967 B2 * 2/2005 Loyd et al. ..... 472/128
6,948,954 B1 * 9/2005 Fan ..... 439/137
2004/0048508 A1 * 3/2004 He et al. ..... 439/342

FOREIGN PATENT DOCUMENTS

| | | |
|---|---|---|
| JP | 57-158969 | 9/1982 |
| JP | 2-50975 | 4/1990 |
| JP | 3-79180 | 8/1991 |
| JP | 2959094 | 5/1992 |

* cited by examiner

*Primary Examiner*—Chandrika Prasad
(74) *Attorney, Agent, or Firm*—Bacon & Thomas, PLLC

(57) ABSTRACT

The present invention relates to a board connector for electrically connecting together circuit boards which are incorporated in, for example, a mobile telephone. A dust-proof measure is carried out by swingably attaching a cover member to a plug via a fulcrum shaft, and covering contact portions of the plug and socket in a fitting state with the cover member. In one of the plug and the cover member, a protrusion which causes an end portion to continuously butt against another one of the plug and the cover member from one end to another end is disposed, whereby, when the plug is inserted, the force of inserting the plug is evenly transmitted from the cover member to the whole plug. Joining portions which, when the plug and the socket are fitted to each other, are joined to each other in a front side with respect to the fulcrum shaft are disposed in the socket and the cover member. The plug is pulled up with using the cover member as a lever by swinging the cover member with setting the joining portions as a lever fulcrum.

24 Claims, 11 Drawing Sheets

BOARD CONNECTOR

BACKGROUND OF THE INVENTION

1. Field of the Invention

The present invention relates to a board connector for electrically connecting together circuit boards which are incorporated in, for example, a mobile telephone.

2. Description of the Prior Art

A plurality of circuit boards (PCBs, hereinafter referred to merely as "boards") are incorporated in a mobile telephone. A conventional board connector for electrically connecting the boards to each other has the following configuration. One-end sides of plural socket contacts which are fixed in parallel to a socket are fixed to one of the boards by soldering, and the socket is mounted on the board. By contrast, one-end sides of plural socket contacts which are fixed in parallel to another socket are fixed to the other board by soldering, and the other socket is mounted on the other board. A plug in which one-end sides of plug contacts configured by plural thin conductors are fixed in parallel is fitted to the socket, and one-end sides of the plug contacts are contacted with and held by the socket contacts. Another plug to which the other-end sides of the plug contacts are fixed in parallel is fitted to the other socket, and the other-end sides of the plug contacts are contacted with and held by the other socket contacts. As a result, the boards are electrically connected to each other.

In the case where plural thin conductors are used as plug contacts in a board connector for electrically connecting together boards, an insulation plate which holds the plug contacts at regular intervals is disposed so as prevent the plug contacts from contacting with each other (Japanese Patent No. 2,959,094)

SUMMARY OF THE INVENTION

Problems to be solved by the invention are that, in a board connector, a narrow pitch of contacts of a plug and socket easily causes a trouble such as a contact failure between the contacts of the plug and socket due to dust or the like, and that multiplication of the number of pins by which the number of contacts is increased disables easy insertion and extraction of a plug.

In order to solve the problems, the board connector of the invention comprises: a plug in which one-end sides of plug contacts configured by plural thin conductors are fixed in parallel to a plug body made of an insulating material; a socket in which a plug fitting recess is disposed in a socket body made of an insulating material, socket contacts configured by plural thin conductors are fixed in parallel to the socket body, and movable contact pieces that are disposed in one-end sides of the socket contacts, and that are elastically displaceable are projected in the plug fitting recess; and a cover member which is attached to the plug to cover the plug and the socket that are in a fitting state. Contact portions of the plug and socket in the fitting state are covered by the cover member to cause dust and the like to hardly enter therein, thereby suppressing occurrence of a contact failure between the contacts of the plug and socket because of a narrowed pitch.

In the invention, preferably, the cover member is swingably attached to the plug via a fulcrum shaft.

Preferably, in one of the plug and the cover member, a protrusion which causes an end portion to continuously butt against another one of the plug and the cover member from one end to another end is disposed. According to the configuration, when the plug is inserted, the force of inserting the plug can be evenly transmitted from the cover member to the whole plug. Even when the number of contacts is increased as a result of multiplication of the number of pins, therefore, insertion of the plug can be easily performed.

Preferably, the board connector further comprises engaging means for, when the plug and the socket are fitted to each other, fixing the cover member to the socket.

Preferably, joining portions which, when the plug and the socket are fitted to each other, are joined to each other in a front side with respect to the fulcrum shaft are disposed in the socket and the cover member, and the plug is pulled up by swinging the cover member with setting the joining portion with the socket as a fulcrum. According to the configuration, the plug can be pulled up by a small force with using the cover member as a lever. Even when the number of contacts is increased as a result of multiplication of the number of pins, therefore, extraction of the plug can be easily performed.

Preferably, in addition to the plug, the socket, and the cover member constituting the board connector, the board connector further comprises another plug, another socket, and another cover member constituting another board connector having a same structure as the board connector, other-end sides of the plug contacts are fixed in parallel to a plug body of the other plug, the socket is mounted on a board, the other socket is mounted on another board, and the boards are electrically connected to each other by the board connector and the other board connector.

Preferably, the board connector further comprises an insulating member made of an insulating material, plural thin contact grooves through which plug contacts between the plug and the other plug are to be passed are alternately disposed in one and other faces of the insulating member, and the insulating member is pressingly held in a movable manner by the plug contacts passed through the contact grooves disposed in the one face of the insulating member, and the plug contacts passed through the contact grooves disposed in the other face of the insulating member. According to the configuration, a predetermined gap is ensured between the plug contacts by the insulating member which is not fixed to the plug contacts, so that the plug contacts are prevented from contacting with each other. Therefore, the attachment position and number of the insulating member can be easily changed, and can readily cope with the connecting configuration such as the connecting distance between the boards and the connecting direction thereof.

As described above, according to invention, it is possible to provide a connector in which, even when the pitch of contacts of a plug and socket is narrowed and the number of pins is increased, a contact failure between the contacts of the plug and socket due to dust or the like can be suppressed, and insertion and extraction of the plug can be easily performed.

Figure 6A:
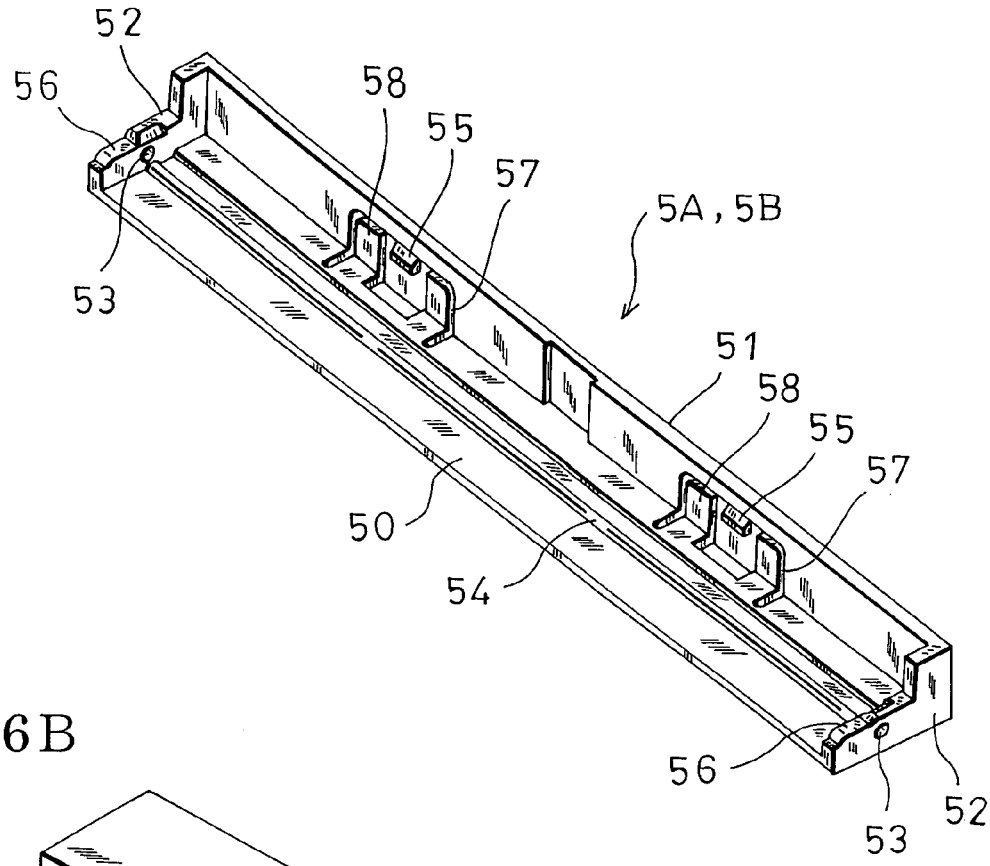
Figure 6B:
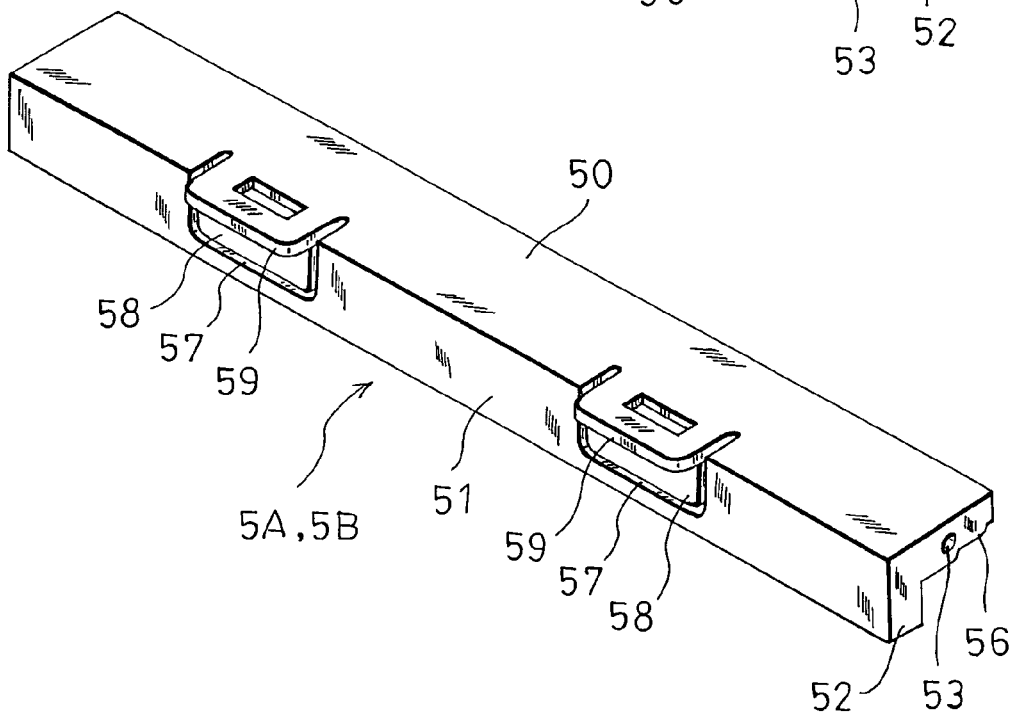
Figure 7:
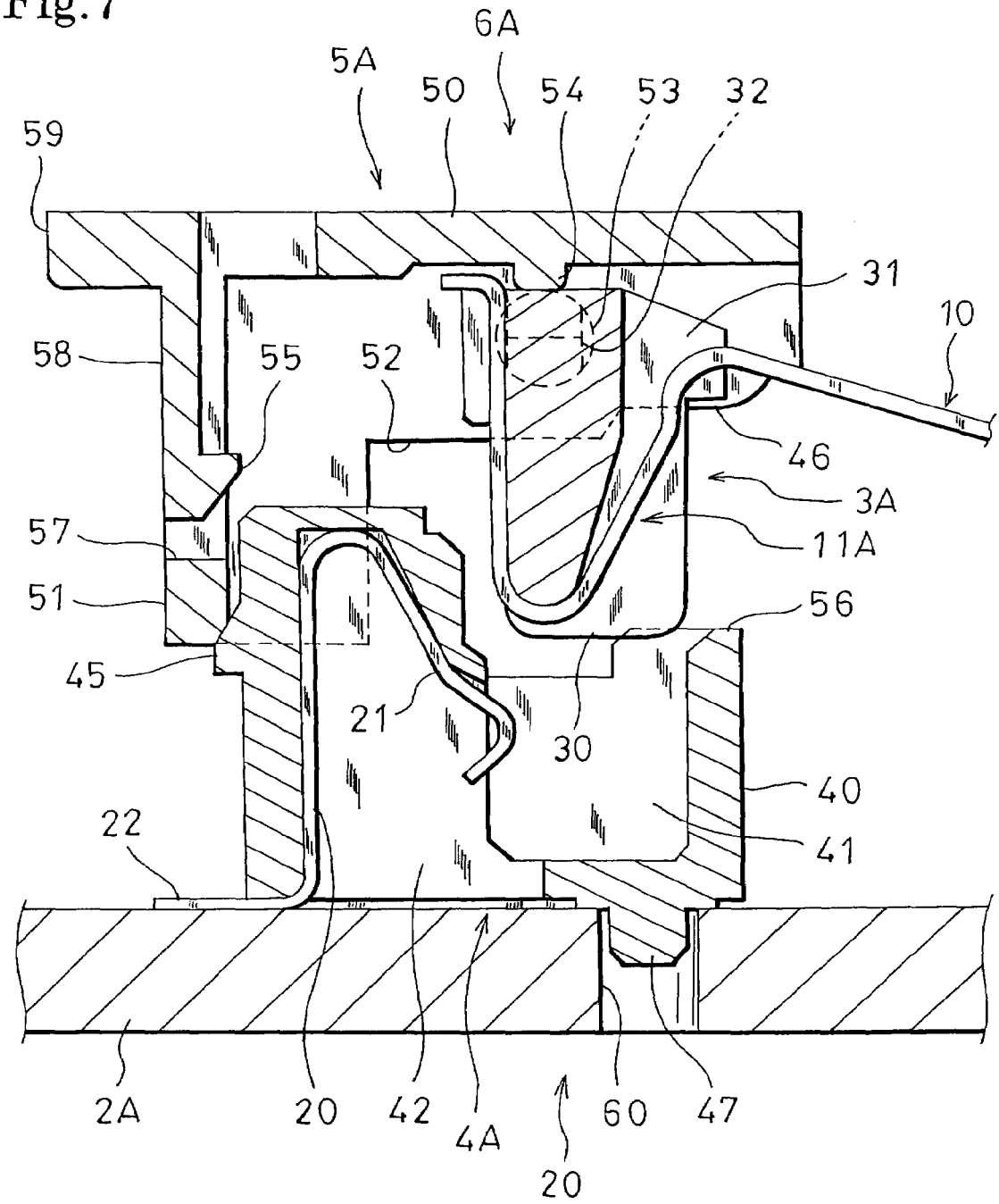
Figure 8:
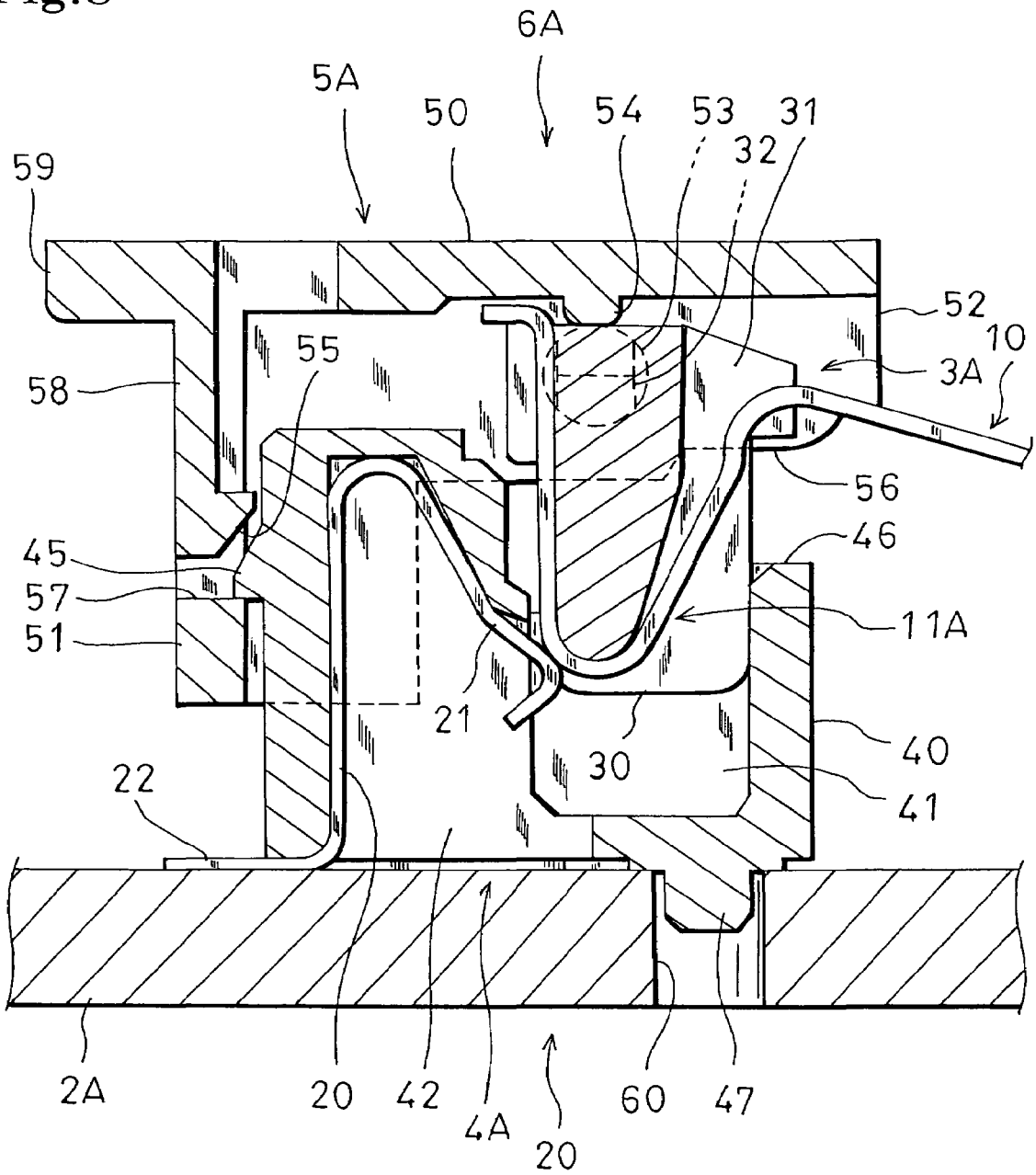
Figure 9:
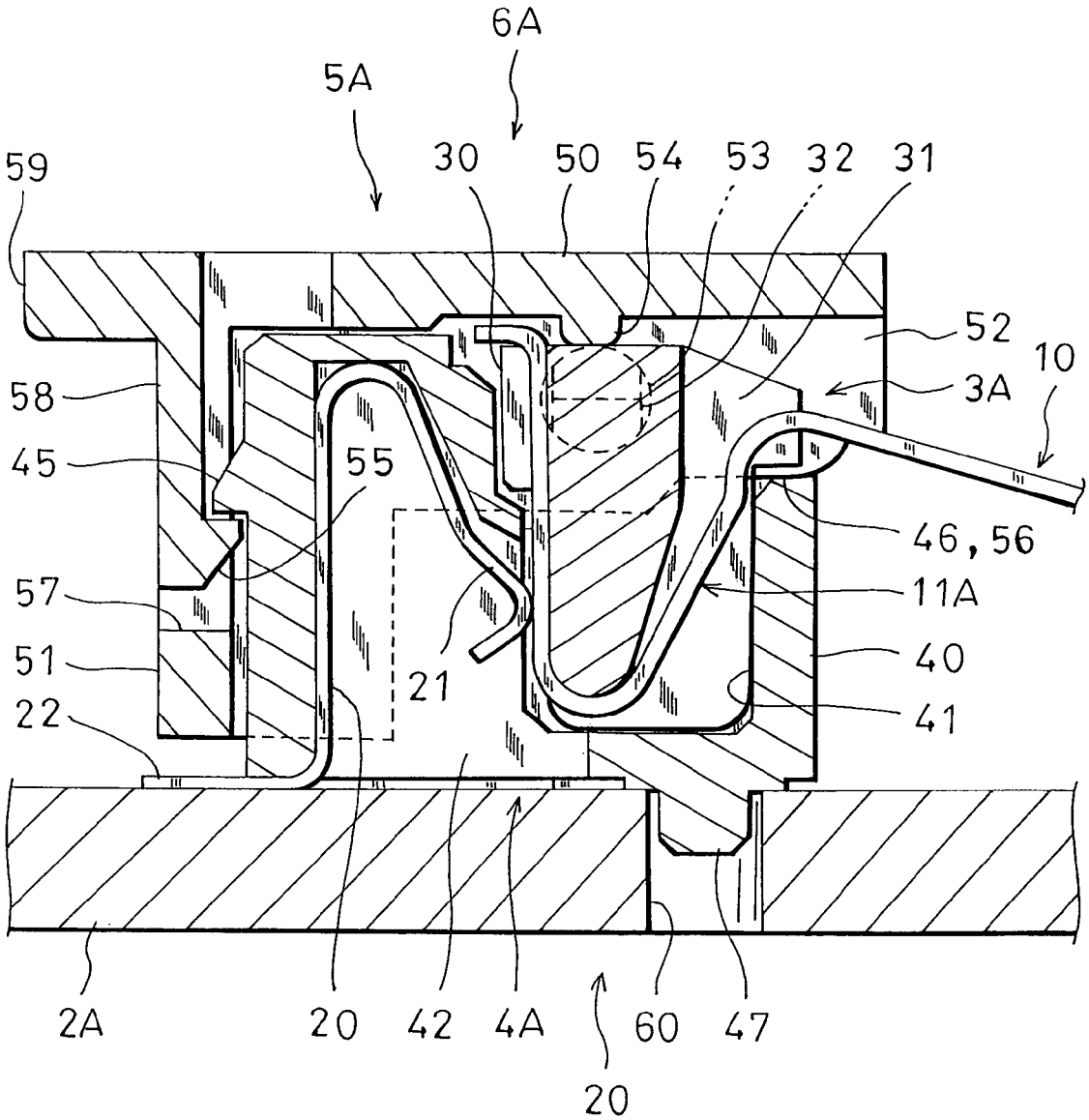
Figure 10:
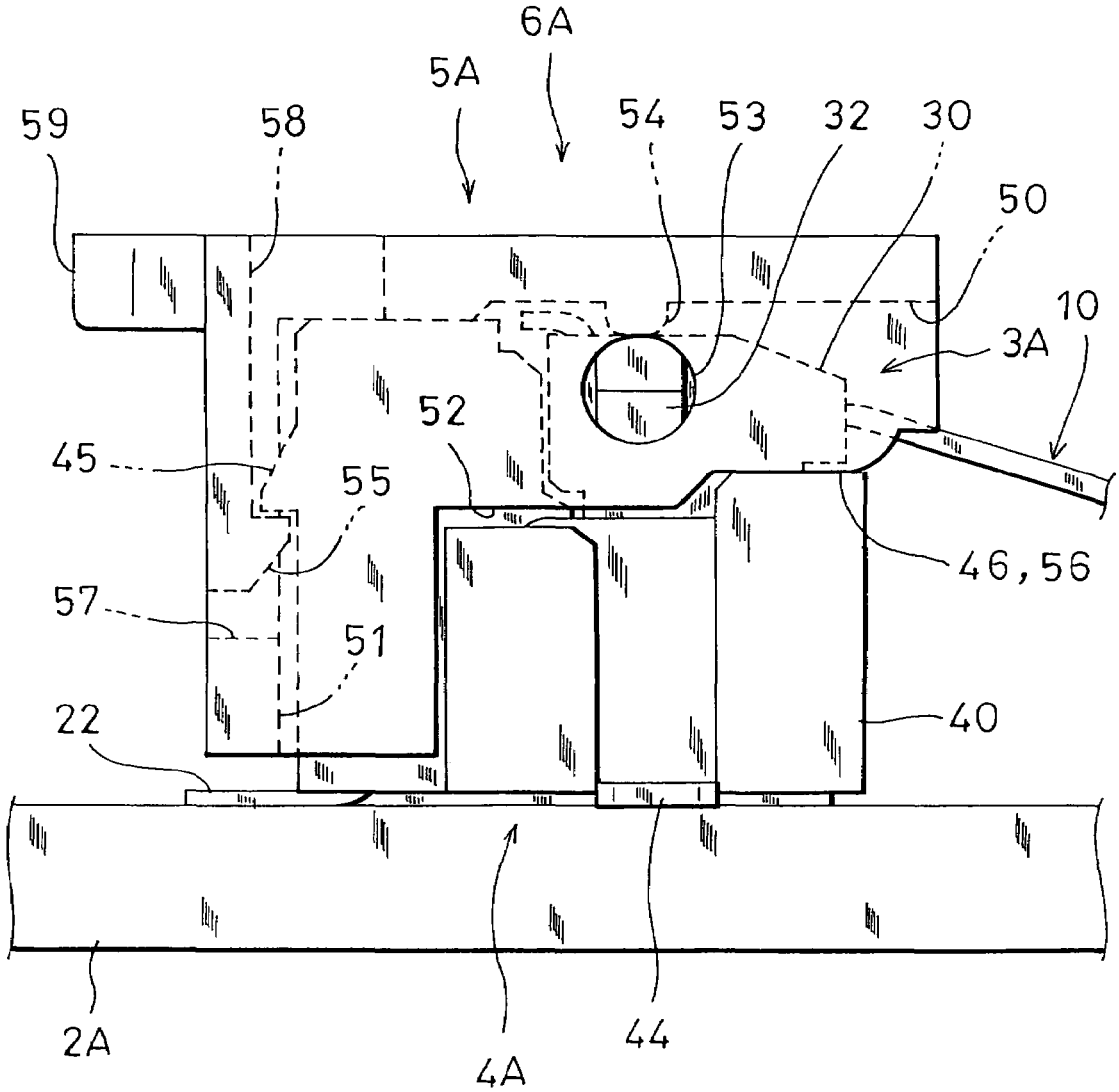
Figure 11:
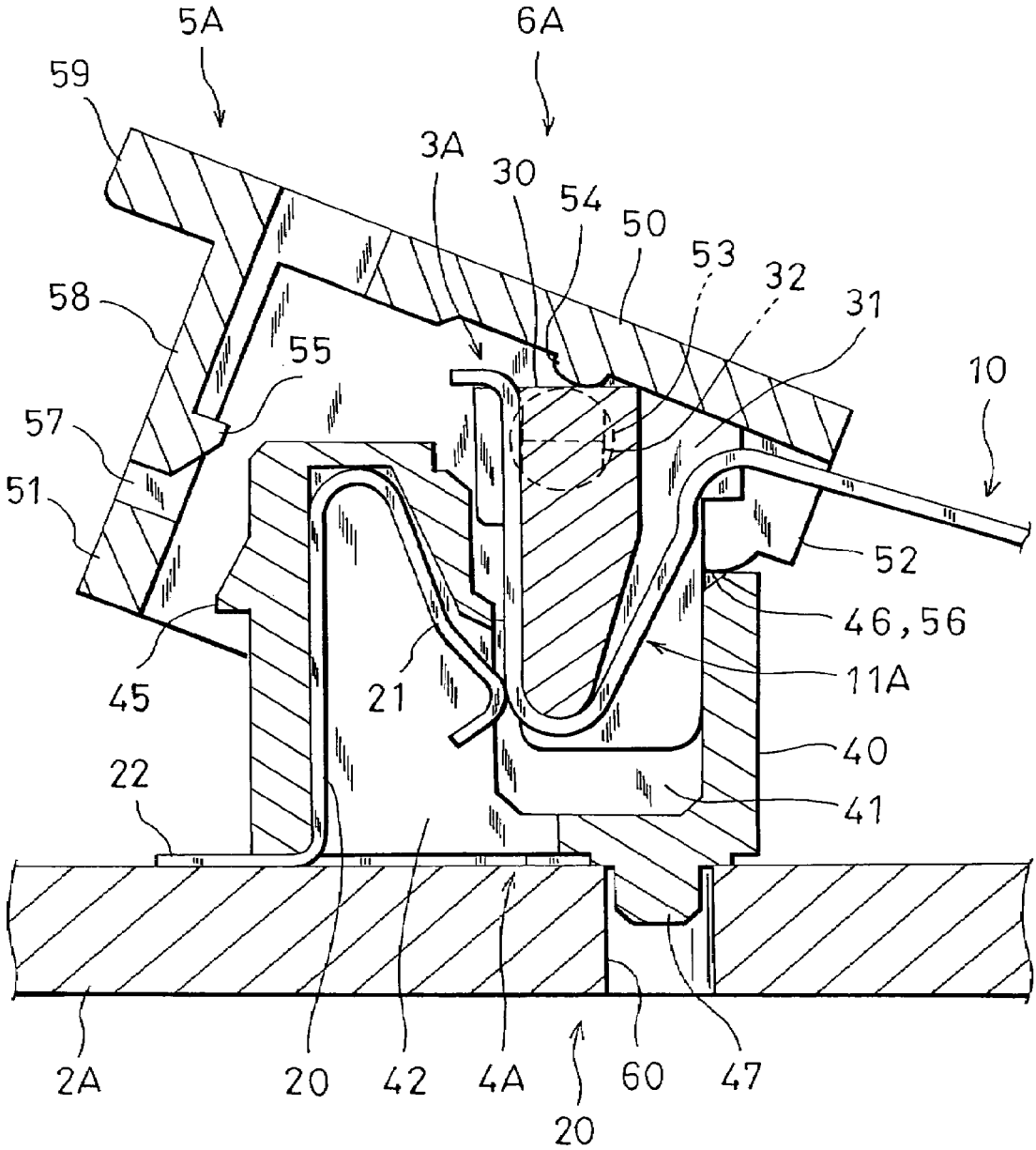

is a side view of a plug contact in which a linear portion has a low-level intermediate portion;

FIG. 6(A) is an external view of an inner face side of a cover member, and FIG. 6(B) is an external view of an outer face side of the cover member;

FIG. 7 is a section view of the board connector showing a plug insertion starting state in fitting of a plug and a socket;

FIG. 8 is a section view of the board connector showing a plug insertion intermediate state in fitting of the plug and the socket;

FIG. 9 is a section view of the board connector showing a fitting state of the plug and the socket (plug insertion completed state);

FIG. 10 is a side view of the board connector showing the fitting state of the plug and the socket; and FIG. 11 is a section view of the board connector showing a state where the plug is pulled up in a plug fitting recess of the socket with using the cover member as a lever in extraction of the plug.

DETAILED DESCRIPTION OF THE PREFERRED EMBODIMENT

Hereinafter, a board connector of an embodiment of the invention will be described with reference to the accompanying drawings. As shown in FIGS. 1 to 4, the board connector 1 is used for electrically connecting a board (PCB) 2A and another board (PCB) 2B which are juxtaposed, and configured by: a board connector 6A which is configured by adding a cover member 5A to a pair of a plug 3A and a socket 4A; another board connector 6B which is configured by adding another cover member 5B to a pair of a plug 3B and a socket 4B; and an insulating member 7.

In the plug 3A, plural thin contact grooves 31 are disposed in parallel at predetermined intervals (regular intervals) in the right and left or lateral direction in a plug body 30 which is made of an insulating material (synthetic resin), and which has an approximately rectangular parallelepiped shape that is laterally elongated. One-end sides 11A of plug contacts 10 which are configured by plural thin plate-like conductors, and which are easily bent or bendable are fitted into the contact grooves 31 from the side of the lower end (insertion side end) of the plug body 30. The one-end sides 11A are bent into a substantially U-like shape along the longitudinal direction of the plug contacts. In the plug contacts 10, outer-side pieces elongating from lower-end bent portions of the one-end sides 11A are pressingly inserted into and fixed to the respective contact grooves 31 so as to be substantially flush with the rear side face of the plug body 30, and inner-side pieces elongating from lower-end bent portions of the one-end sides 11A are fitted into the contact grooves 31 in an elastically deformable manner in the front side of the plug body 30, so that the one-end sides 11A of the plug contacts 10 are fixed in an insulated state in parallel at predetermined intervals (regular intervals) in the right and left or lateral direction. On the rear side face of the plug 3A, therefore, the outer-side pieces elongating from the lower-end bent portions of the one-end sides 11A are exposed in a substantially flush manner, and, from an upper portion of the front side face of the plug 3A, the plug contacts 10 are drawn out. In order to attach the cover member 5A to the plug 3A, a horizontal laterally-directed fulcrum shaft 32 which is perpendicularly projected from upper portions of the right and left side faces of the plug body 30 is integrally disposed.

In the socket 4A, a plug fitting recess 41 into which the plug 3A is inserted from the upper face side and fitted is disposed in a front portion of a socket body 40 which is made of an insulating material (synthetic resin), and which has an approximately rectangular parallelepiped shape that is laterally elongated. Plural thin contact grooves 42 in which the lower ends are opened in the bottom face of the socket body 40, and which communicate with the plug fitting recess 41 with breaking a partition wall with respect to the plug fitting recess 41 are disposed in parallel at predetermined intervals (regular intervals) in the right and left or lateral direction in a rear portion of the socket body 40. Plural legged socket contacts 20 which are configured by plural thin plate-like conductors, and which are bent into a substantially inverted U-like shape along the longitudinal direction are fitted into the contact grooves 42 from the bottom face side of the socket body 40. In the socket contacts 20, rear side pieces elongating from upper-end bent portions are pressingly inserted into and fixed to the respective contact grooves 42 so as to elongate along the rear wall faces of the contact grooves 42, and front side pieces elongating from the upper-bent portions, i.e., movable contact pieces 21 which are disposed in one-end sides of the socket contacts 20, and which are elastically displaceable are fitted into the contact grooves 42 in an elastically deformable manner. Tip end portions (free-end portions) of the movable contact pieces 21 are projected in the plug fitting recess 41. In a state where leg portions which are horizontally rearward extended from lower ends of the rear side pieces with respect to the upper-end bent portions of the socket contacts 20, i.e., soldering portions 22 which are disposed in the other-end sides of the socket contacts 20 are projected in the rear outer side of the socket body 40 so as to be substantially flush with the bottom face of the socket body 40, the socket contacts 20 are fixed in an insulated state in parallel at predetermined intervals (regular intervals) in the right and left or lateral direction. Thin groove holes 43 are disposed in a front portion of the socket body 40 and in right and left outer sides of the plug fitting recess 41. One piece of a reinforcing terminal 44 which is an L-like metal part is pressingly inserted into and fixed to each of the groove holes 43 from the side of the bottom face of the socket body 40, and the other piece of the reinforcing terminal 44, i.e., a soldering portion (leg portion) is projected to each of the right and left outer sides of the socket body 40 so as to be substantially flush with the bottom face of the socket body 40. Therefore, a plug insertion port (the open end of the plug fitting recess 41) is opened in a front portion of the upper face of the socket 4A, and the soldering portions 22 of the socket contacts 20 and the soldering portions of the reinforcing terminals 44 are exposed on the bottom face of the socket 4A so as to be substantially flush with each other. The soldering portions 22 of the socket contacts 20 are projected to the rear outer side of the socket 4A, and the soldering portions of the reinforcing terminals 44 are projected to the right and left outer sides of the socket 4A. In order to fix the cover member 5A when the plug 3A and the socket 4A are fitted to each other, engagement claws 45 are integrally disposed in right and left or two places of the rear side face of the socket body 40.

The socket 4A is surface-mounted on the board 2A, whereby the soldering portions 22 of the socket contacts 20 and the soldering portions of the reinforcing terminals 44 are fixed by soldering to the board 2A, and the socket contacts 20 are electrically connected to the board 2A. In the socket 4A, positioning protrusions 47 are integrally disposed in two places of the bottom face of the socket body 40 in order to fit the socket to positioning holes 60 disposed in the board 2A and position the socket with respect to the board 2A.

The cover member 5A is a molded piece made of an insulating material (synthetic resin), and covers the plug 3A and the socket 4A in the fitting state from the upper and rear sides. As shown in FIG. 6 also, in the cover member 5A, the following components are integrally disposed: a rectangular plate-like cover top plate portion 50 which covers the plug 3A and the socket 4A in the fitting state from the upper side; a rectangular plate-like cover rear side plate portion 51 which is perpendicularly continuous to the rear edge of the cover top plate portion 50, which covers the plug 3A and the socket 4A in the fitting state from the rear side, and which covers the soldering portions 22 of the socket contacts 20 from the upper side; and cover right and left side plate portions 52 which are perpendicularly bent so as to extend along the right and left side edges of the cover top plate portion 50 and those of the cover rear side plate portion 51, which are projected from a front portion of the upper side face of the socket 4A into which the plug 3A is fitted, and which laterally integrally cover rear portions of the right and left side faces of the socket 4A from upper portions of the right and left side faces of the plug 3A. In the cover member 5A, front portions of the right and left side plate portions 52 are pivotally supported via mounting holes 53 by the fulcrum shaft 32 which is disposed on the plug 3A. The cover member 5A is swingably attached to the plug 3A via the fulcrum shaft 32. The plug 3A is set by the cover member 5A to a state where the upper, rear, and right and left sides are covered, and the front side in the direction of drawing out the plug contacts 10, and the lower side in the direction of inserting the contacts into the socket 4A are opened. In the cover member 5A, a protrusion 54 in which the tip end continuously butts against the upper end face of the plug 3A in a range from the left end to the right end at a swing position where the cover top plate portion 50 is perpendicular to the plug 3A is integrally disposed on the inner face of the cover top plate portion 50, and engagement claws 55 which, when the plug 3A and the socket 4A are fitted to each other, are engaged in the plug extraction direction with the engagement claws 45 disposed on the socket body 40 to fix the cover member 5A to the socket 4A are integrally disposed in right and left or two places of the inner face of the cover rear side plate portion 51. Furthermore, joining portions 46, 56 which, when the plug 3A and the socket 4A are fitted to each other, are joined to each other in a front side with respect to the fulcrum shaft 32 are disposed in the socket 4A and the cover member 5A. When the plug 3A and the socket 4A are fitted to each other, front-end portions of the lower end faces of the cover right and left side plate portions 52 are joined to right and left end portions of the upper end face of the front sidewall of the socket body 40. The right and left end portions of the upper end face of the front sidewall of the socket body 40 are set as the joining portions 46 on the side of the socket 4A, and the front end portions of the lower end faces of the cover right and left side plate portions 52 are set as the joining portions 56 on the side of the cover member 5A.

In the cover member 5A, U-like cutaways 57 which are upward opened are formed in right and left or two places of an upper portion of the cover rear side plate portion 51, right and left side portions of the cutaways 57 are elongated from a rear portion of the cover top plate portion 50, and movable plate portions 58 which are surrounded by the cutaways 57, which are configured by parts of the cover rear side plate portion 51 and a part of the cover top plate portion 50, and which are perpendicularly bent are integrally disposed. In the movable plate portions 58, operation levers 59 which are projected from and flushly with parts of the cover top plate portion 50 more rearward than parts of the cover rear side plate portion 51 are integrally disposed, and the engagement claws 55 on the side of the cover member 5A are integrally disposed on the inner faces of lower end portions of parts of the cover rear side plate portion 51 which are free-end portions of the movable plate portions 58. In order to facilitate elastic deformation, parts of the cover rear side plate portion 51 in the movable plate portions 58 are thinned.

As described above, the board connector 6A is configured as a board connector with a dust-proof cover in which the cover member 5A is added to the pair of the plug 3A and the socket 4A.

Figure 3:
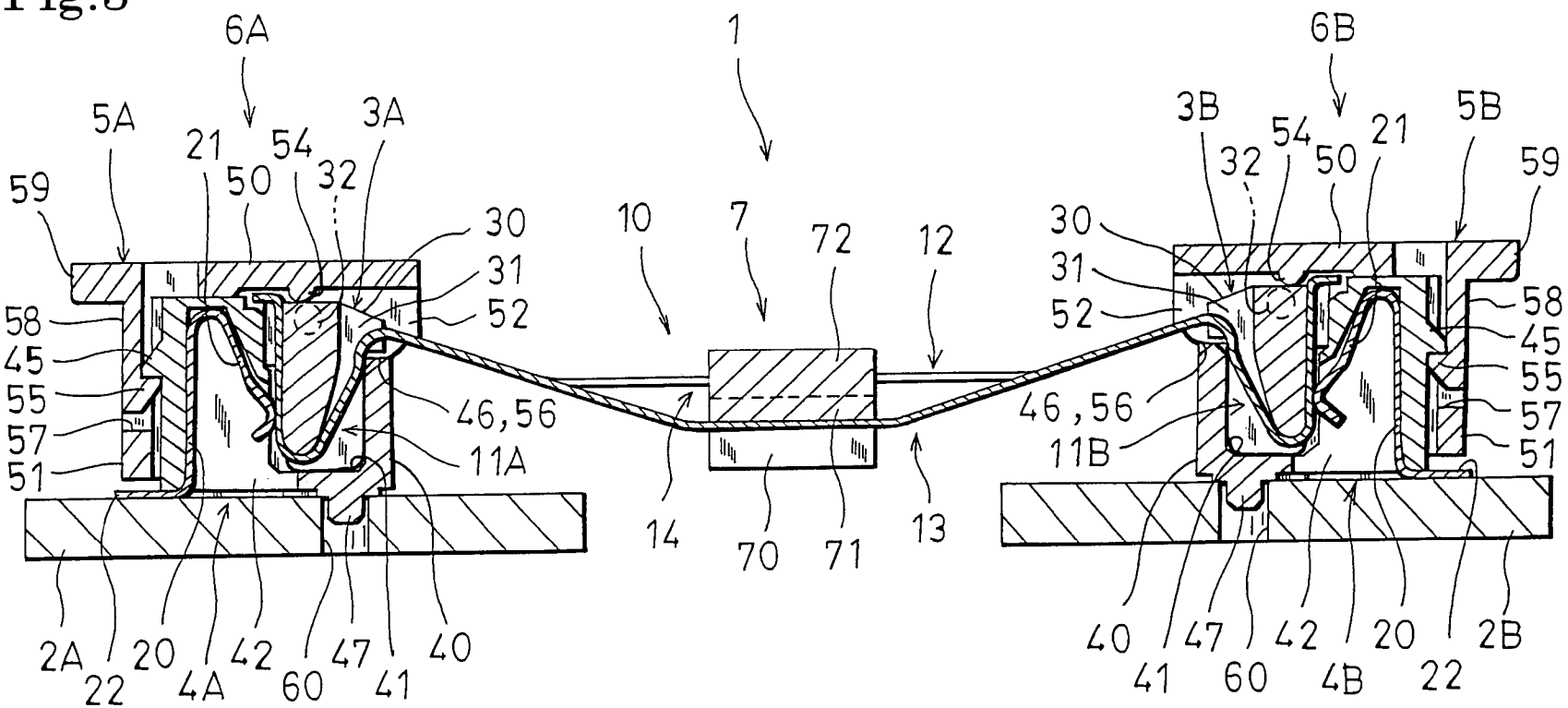
FIG. 3 is a section view of the board connector taken along the line A—A in FIG. 1.
Figure 4:
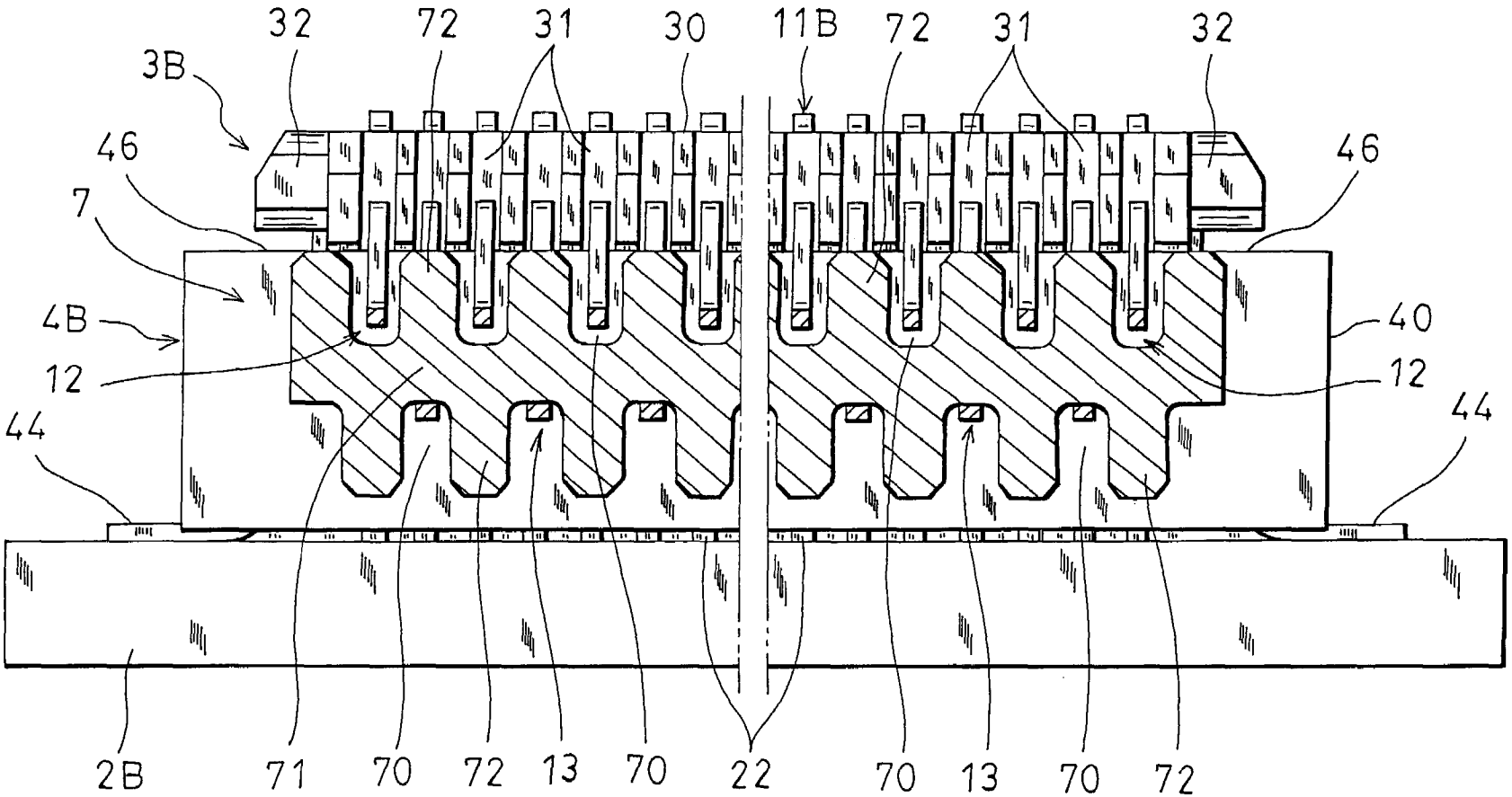
FIG. 4 is a section view of the board connector taken along the line B—B in FIG. 1.
Figure 5A:
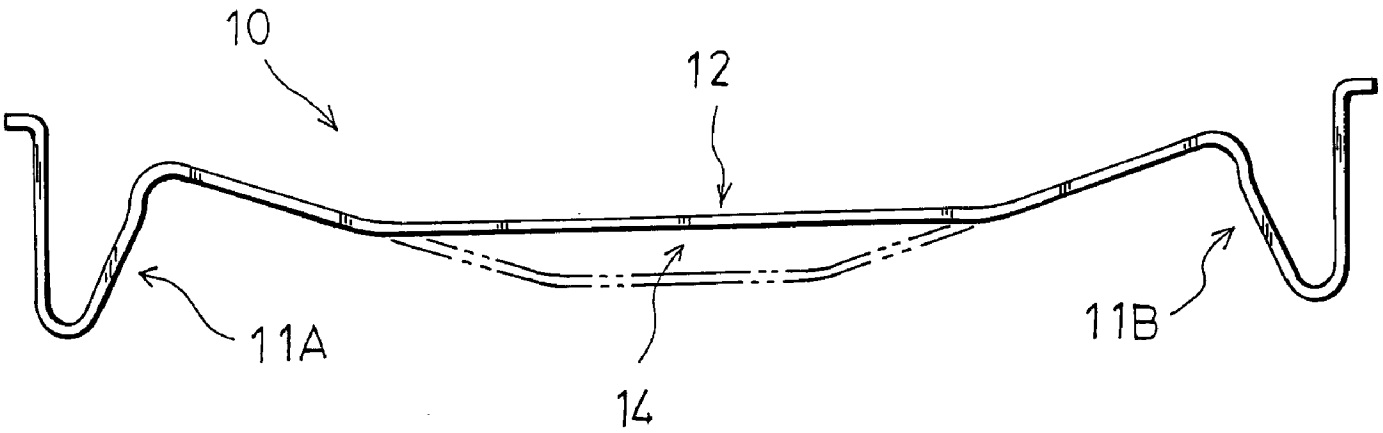
FIG. 5(A) is a side view of a plug contact in which a linear portion has a high-level intermediate portion, and FIG. 5(B)
Figure 5B:
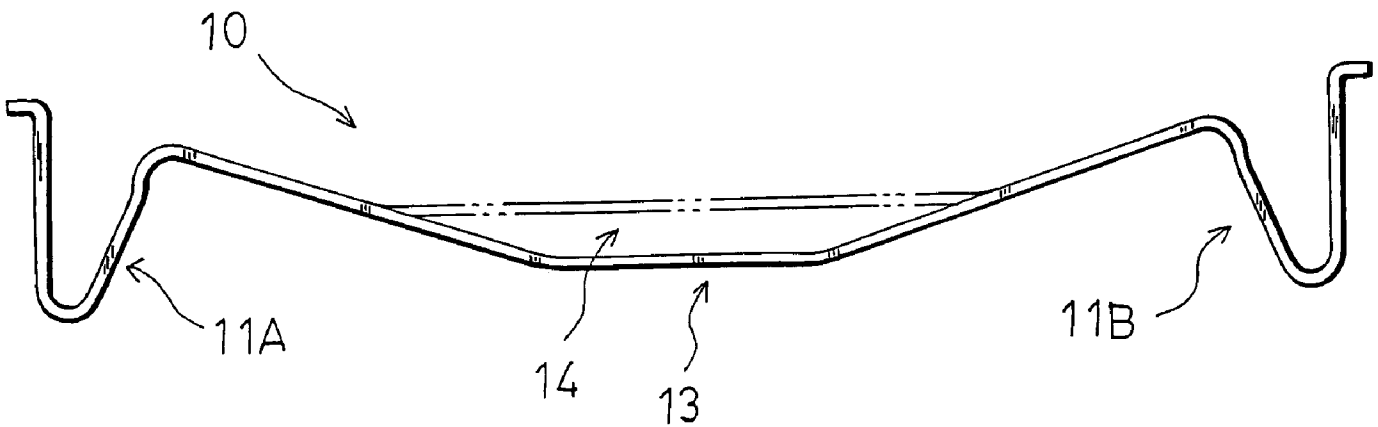

Next, the other pair of plug 3B and socket 4B of the other board connector 6B, and the cover member 5B to be added to the plug and the socket have the same structure as the pair of plug 3A and socket 4A of the board connector 6A and the cover member 5A to be added to the plug and the socket, and the other board connector 6B is configured as the same board connector with a dust-proof cover as the board connector 6A. Therefore, the identical components are denoted by the same reference numerals, and there detailed description is omitted. As shown in FIG. 3, however, the other plug 3B of the other board connector 6B is configured so that other one-end sides 11B which are bent into a substantially U-like shape along the longitudinal direction of the plug contacts 10 are fixed to the plug body 30 in an insulated state in parallel at predetermined intervals (regular intervals) in the right and left or lateral direction. Furthermore, the other socket 4B of the other board connector 6B is surface-mounted on the other board 2B, whereby the soldering portions 22 of the socket contacts 20 and the soldering portions of the reinforcing terminals 44 are fixed by soldering to the board 2B, and the socket contacts 20 are electrically connected to the board 2B.

Next, a plug insertion method in which, in order to fit the plug 3A and socket 4A of the board connector 6A to each other, the plug 3A is inserted into the plug fitting recess 41 of the socket 4A will be described with reference to FIGS. 7 to 10.

As shown in FIG. 7, first, the cover member 5A which is swingably attached via the fulcrum shaft 32 to the plug 3A is swung about the fulcrum shaft 32, and held to a swing position where the cover top plate portion 50 is perpendicular to the plug 3A and the tip end of the protrusion 54 butts against the upper end face of the plug 3A. By butting (surface contact) between the tip end of the protrusion 54 and the upper end face of the plug 3A, the plug 3A is held to a posture perpendicular to the cover top plate portion 50. In this state, the cover member 5A is positioned directly above the socket 4A mounted on the board 2A, and the cover member 5A is lowered to approach the board 2A, whereby the rear lower end side of the cover member 5A is fitted from the upper side into the tall rear outer side of the socket 4A. As result of this fitting, the cover member 5A and the plug 3A are positioned with respect to the socket 4A, and the plug 3A is positioned directly above the plug fitting recess 41 of the socket 4A. In this state, the cover member 5A is further lowered to approach the board 2A, whereby, while the rear portion of the cover member 5A is further fitted into the rear outer side of the socket 4A, the lower end portion of the plug 3A is fitted into the plug insertion port opened in the low-height front upper face side of the socket 4A (start of plug insertion). In this state, the cover member 5A is further lowered to approach the board 2A, whereby, while the rear portion of the cover member 5A is further fitted into the rear outer side of the socket 4A as shown in FIG. 8, the plug 3A is inserted into the plug fitting recess 41 of the socket 4A until the lower-end bent portions of the one-end sides 11A of the plug contacts 10 hit the tip end portions of the movable contact pieces 21 of the socket contacts 20 which are projected in the plug fitting recess 41 of the socket 4A. In the subsequent insertion, the movable contact pieces 21 of the socket contacts 20 produce an insertion resistance against the plug 3A. When the cover member 5A is pressed down to cause the protrusion 54 of the cover top plate portion 50 to press down the plug 3A, therefore, the rear portion of the cover member 5A presses the movable contact pieces 21 of the socket contacts 20 to cause the contacts to be elastically deformed, while the rear portion of the cover member 5A is further fitted into the rear outer side of the socket 4A, and the tip end portions of the movable contact pieces 21 are pressed back from the plug fitting recess 41 into the contact grooves 42. When the plug 3A passes beyond the tip end portions of the movable contact pieces 21 to be further inserted into the plug fitting recess 41 of the socket 4A, the tip end portions of the movable contact pieces 21 of the socket contacts 20 are pressed against and contacted with the outer-side pieces elongating from the lower-end bent portions of the one-end sides 11A of the plug contacts 10 which are exposed on the rear side face of the plug 3A so as to be substantially flush with each other. In this state, the cover member 5A is further pressed down, and the plug 3A is pressed down by the protrusion 54 of the cover top plate portion 50. As a result, as shown in FIGS. 9 and 10, while the rear portion of the cover member 5A is further fitted into the rear outer side of the socket 4A, the plug 3A is completely inserted into the plug fitting recess 41 of the socket 4A until the lower end of the plug 3A bumps against the bottom face of the plug fitting recess 41 of the socket 4A, whereby the plug 3A and the socket 4A are fitted together (completion of the plug insertion).

During fitting of the plug 3A and the socket 4A (when the plug 3A and the socket 4A are to be fitted to each other), the plug 3A is hidden by the cover member 5A. Since the positioning of the plug 3A with respect to the socket 4A can be performed by the cover member 5A, however, it is not difficult to insert the plug 3A.

As the number of contacts of the plug contacts 10 and socket contacts 20 is more increased because of multiplication of the number of pins of the board connector 6A, the insertion resistance on the plug 3A in fitting of the plug 3A and the socket 4A becomes higher. The protrusion 54 disposed on the cover top plate portion 50 of the cover member 5A continuously butts against the upper end face of the plug 3A in the range from the left end to the right end to press the plug 3A in the insertion direction, and hence the force of inserting the plug can be evenly transmitted by the cover member 5A to the whole plug 3A. Even when the number of contacts is increased as a result of multiplication of the number of pins, therefore, insertion of the plug 3A can be easily performed. In the embodiment, the protrusion 54 is disposed on the side of the cover member 5A. Alternatively, the protrusion may be disposed on the side of the plug 3A.

As shown in FIGS. 1 to 3, 9, and 10, from the timing just before the fitting of the plug 3A and the socket 4A, the engagement claws 55 disposed on the movable plate portions 58 of the cover member 5A ride on the engagement claws 45 disposed on the socket 4A while producing elastic deformation of the movable plate portions 58, the engagement claws 55 disposed on the movable plate portions 58 of the cover member 5A pass beyond the engagement claws 45 disposed on the socket 4A to enter below the claws when the plug 3A and the socket 4A are fitted together, and at the same time the engagement claws 55 disposed on the movable plate portions 58 of the cover member 5A are engaged with the engagement claws 45 disposed on the socket 4A in the plug extraction direction by an elastic return of the movable plate portions 58. Therefore, the cover member 5A is fixed (locked) to the socket 4A, the plug 3A is fixed (locked) to the socket 4A by the fixed cover member 5A, and the fitting states of the plug 3A and the socket 4A, and the cover member 5A and the socket 4A are held. As a result, in the plug fitting recess 41 of the socket 4A, the contact between the outer-side pieces elongating from the lower-end bent portions of the one-end sides 11A of the plug contacts 10, and the tip end portions of the movable contact pieces 21 of the socket contacts 20 is held, and the one-end sides 11A of the plug contacts 10 are electrically connected to the board 2A.

When the plug 3A and the socket 4A are fitted together, the plug 3A and the socket 4A in the fitting state are covered from the upper and rear sides by the cover member 5A fixed to the socket 4A, and contact portions of the plug 3A and socket 4A in the fitting state, i.e., the plug fitting recess 41 of the socket 4A is covered to cause dust and the like to hardly enter the plug fitting recess 41. Therefore, occurrence of a contact failure between the contacts 10, 20 of the plug 3A and socket 4A because of a narrowed pitch of the contacts 10, 20 can be suppressed. Furthermore, the soldering portions 22 of the socket contacts 20 are covered from the upper side by the cover member 5A, so that dust and the like hardly fall and deposit on the surfaces of the soldering portions 22 and gaps therebetween. Therefore, an insulation failure in the soldering portions 22 of the socket contacts 20 because of a narrowed pitch of the contacts 10, 20 of the plug 3A and socket 4A can be suppressed.

When the plug 3A and the socket 4A are fitted together, the joining portions 46 on the side of the socket 4A, and joining portions 56 on the side of the cover member 5A which are disposed in the front side with respect to the fulcrum shaft 32 are joined to each other. Namely, the right and left end portions of the upper end face of the front sidewall of the socket body 40 are joined to the front-end portions of the lower end faces of the cover right and left side plate portions 52.

A plug insertion method in which, in order to fit the plug 3B and socket 4B of the other board connector 6B to each other, the plug 3B is inserted into the plug fitting recess 41 of the socket 4B, and a fitting state of the plug 3B and the socket 4B are identical with the plug insertion method of the board connector 6A and the fitting state of the plug 3A and the socket 4A shown in FIGS. 7 to 10. Therefore, their detailed description and corresponding drawings are omitted.

Figure 1:
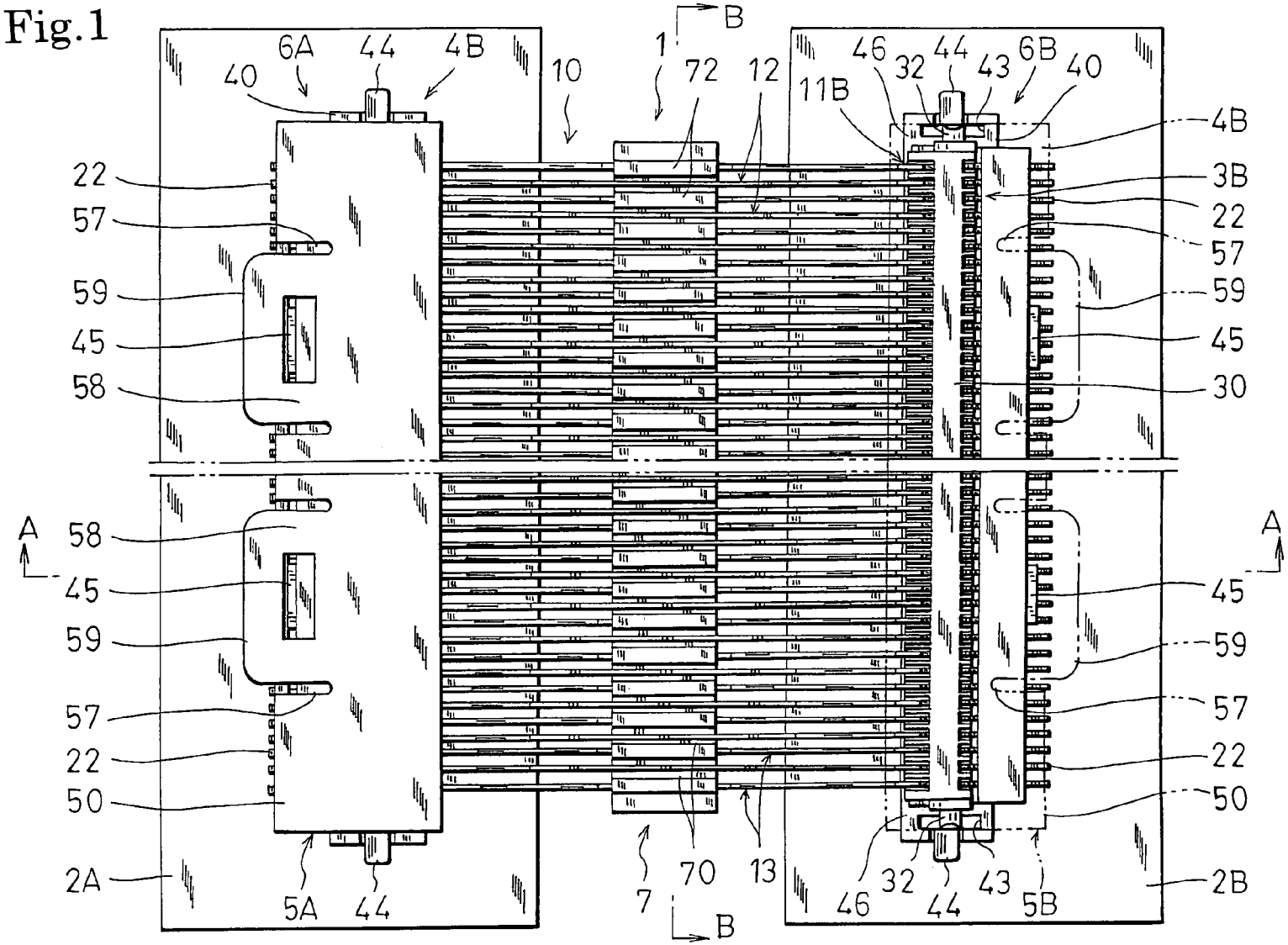
FIG. 1 is a plan view of a board connector of an embodiment of the invention.
Figure 2:
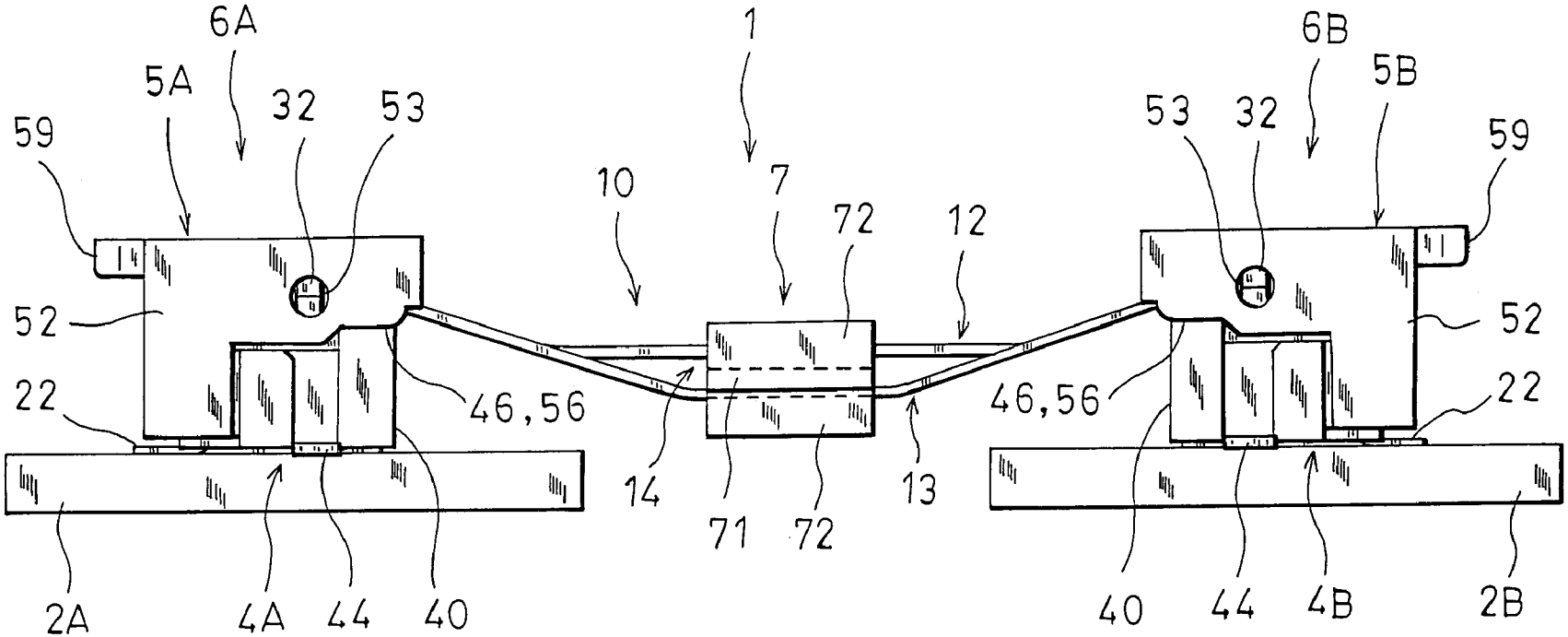
FIG. 2 is a side view of the board connector.

As shown in FIGS. 1 to 3, in the board connector 6A, the plug 3A is inserted and fitted into the plug fitting recess 41 of the socket 4A, and, in the plug fitting recess 41 of the socket 4A, and the outer-side pieces elongating from the lower-end bent portions of the one-end sides 11A of the plug contacts 10, and the tip end portions of the movable contact pieces 21 of the socket contacts 20 are contacted and held to each other, thereby electrically connecting the one-end sides 11A of the plug contacts 10 to the board 2A. By contrast, in the other board connector 6B, the other plug 3B is inserted and fitted into the plug fitting recess 41 of the other socket 4B, and, in the plug fitting recess 41 of the socket 4B, and the outer-side pieces elongating from the lower-end bent portions of the other-end sides 11B of the plug contacts 10, and the tip end portions of the movable contact pieces 21 of the socket contacts 20 are contacted and held to each other, thereby electrically connecting the other-end sides 11B of the plug contacts 10 to the board 2B. Therefore, the board 2A and the other board 2B can be electrically connected together via the plug contacts 10, the socket contacts 20 of the socket 4A, and the socket contacts 20 of the other socket 4B.

Next, a plug extraction method in which, in order to separate from each other the plug 3A and socket 4A of the board connector 6A in the fitting state shown in FIGS. 1 to 3, 9, and 10, the plug 3A is extracted from the plug fitting recess 41 of the socket 4A will be described with reference to FIG. 11.

First, in the board connector 6A in the fitting state shown in FIGS. 1 to 3, 9, and 10, an operation of lifting up a rear portion of the cover member 5A is performed by engaging the fingers with the operation levers 59 disposed on the movable plate portions 58 of the cover member 5A. When the rear portion of the cover member 5A is lifted up in this way, the engagement claws 55 disposed on the movable plate portions 58 of the cover member 5A separate from the rear side face of the socket body 40 while producing elastic deformation of the movable plate portions 58, and the engagement with the engagement claws 45 disposed on the socket 4A is canceled. In this state, as shown in FIG. 11, the cover member 5A is swung with setting as a lever fulcrum the joining portions 46, 56 joined to each other in the front side with respect to the fulcrum shaft 32 by which the cover member 5A is swingably attached to the plug 3A. In accordance with the swinging operation of the cover member 5A, the plug 3A is pulled up in the plug fitting recess 41 of the socket 4A via the fulcrum shaft 32 (with setting the fulcrum shaft 32 as a point of action). Namely, the plug 3A can be pulled up in the plug fitting recess 41 of the socket 4A with using the cover member 5A as a lever. By the operation of pulling up the plug 3A, the plug 3A is pulled up in the plug fitting recess 41 of the socket 4A by the degree at which the lower end portion of the plug 3A is lifted up to the vicinity of the tip end portions of the movable contact pieces 21 of the socket contacts 20. Then, the cover member 5A is lifted up substantially directly above the socket 4A, whereby the plug 3A is extracted away from the plug fitting recess 41 of the socket 4A.

In the process of pulling up the plug 3A in the plug fitting recess 41 of the socket 4A, in an initial stage of the extraction in which the tip end portions of the movable contact pieces 21 of the socket contacts 20 are in contact with the outer-side pieces elongating from the lower-end bent portions of the one-end sides 11A of the plug contacts 10, the contact pressure functions as a large pulling resistance on the plug 3A. When the lower end portion of the plug 3A is lifted up to the vicinity of the tip end portions of the movable contact pieces 21 of the socket contacts 20, the tip end portions of the movable contact pieces 21 of the socket contacts 20 are contacted with the lower-end bent portions of the one-end sides 11A of the plug contacts 10. At this timing, the contact pressure (the pulling resistance on the plug 3A) is reduced. As the contact pressure is further reduced when the lower end portion of the plug 3A passes beyond the tip end portions of the movable contact pieces 21 of the socket contacts 20 and the one-end sides 11A of the plug contacts 10 separate from the tip end portions of the movable contact pieces 21 of the socket contacts 20, the pulling resistance on the plug 3A is further substantially eliminated. When, as described above, the plug 3A is pulled up with using the cover member 5A as a lever in the plug fitting recess 41 of the socket 4A by the degree at which the lower end portion of the plug 3A is lifted up to the vicinity of the tip end portions of the movable contact pieces 21 of the socket contacts 20, the pulling and extraction of the plug 3A in the plug fitting recess 41 of the socket 4A can be easily performed with applying a small force.

As the number of contacts of the plug contacts 10 and socket contacts 20 is increased as a result of multiplication of the number of pins of the board connector 6A, the pulling resistance on the plug 3A is larger in extraction of the plug 3A fitted to the socket 4A. Since the plug 3A can be pulled up by a small force with using the cover member 5A as a lever in the plug fitting recess 41 of the socket 4A, however, extraction of the plug 3A can be easily performed even when the number of contacts is increased as a result of multiplication of the number of pins.

A plug extraction method in which, in order to separate the plug 3B and socket 4B of the other board connector 6B in the fitting state shown in FIGS. 1 to 3 from each other, the plug 3B is extracted from the plug fitting recess 41 of the socket 4B is identical with the plug extraction method of the board connector 6A shown in FIG. 11. Therefore, its detailed description and corresponding drawings are omitted.

The socket contacts 20 which are configured by plural thin plate-like conductors are formed in parallel into a state where end portions of the soldering portions 22 are continuous to a carrier (not shown) with forming predetermined intervals at predetermined pitches therebetween, by punching and bending a thin conductive metal plate. In this state, the socket contacts 20 are fitted into the contact grooves 42 of the socket body 40, and fixed to the socket body 40 in parallel in an insulated state with forming predetermined intervals (regular intervals) in the right and left or lateral direction, and then the carrier is separated from the socket contacts 20, thereby configuring the sockets 4A, 4B. The plug contacts 10 which are configured by plural thin plate-like conductors, and which are easily bent or bendable are formed in parallel into a state where end portions of the one-end sides 11A are continuous to a carrier (not shown), and end portions of the other-end sides 11B are continuous to another carrier (not shown), by punching and bending a thin conductive metal plate with disposing predetermined intervals at predetermined pitches between the carrier and the other carrier. In this state, the one-end sides 11A of the plug contacts 10 are fitted into the contact grooves 31 of the plug body 30, the one-end sides 11A of the plug contacts 10 are fixed to the plug body 30 in an insulated state in parallel at predetermined intervals (regular intervals) in the right and left or lateral direction, and then the carrier is separated from the one-end sides 11A of the plug contacts 10, thereby configuring the plug 3A. By contrast, the other-end sides 11B of the plug contacts 10 are fitted into the contact grooves 31 of the plug body 30, the other-end sides 11B of the plug contacts 10 are fixed to the plug body 30 in an insulated state in parallel at predetermined intervals (regular intervals) in the right and left or lateral direction, and then the carrier is separated from the other-end sides 11B of the plug contacts 10, thereby configuring the other plug 3B.

As shown in FIGS. 1 to 3, and 5, in the plug contacts 10 through which the plug 3A is linked with the other plug 3B, intermediate portions 12, 13 (between the one-end sides 11A and the other-end sides 11B) between the plug 3A and the other plug 3B are formed into a linear shape so as to elongate in parallel to the boards 2A, 2B, except their both end portions. The both end portions are formed into an inclined state which is upward inclined toward the respective end portions. The lengths of the linear portions of the intermediate portions 12, 13 are set on the basis of the distance between the board 2A and other board 2B which are placed in parallel to each other, i.e., the connecting distance.

One-end side inclined upper ends of the intermediate portions 12, 13, and upper end portions of the inner-side pieces elongating from the lower-end bent portions of the one-end sides 11A are continuously integrally linked with each other, and other-end side inclined upper ends of the intermediate portions 12, 13, and upper end portions of the inner-side pieces elongating from the lower-end bent portions of the other-end sides 11B are continuously integrally linked with each other. The plug contacts 10 are formed so as to be symmetrical about a point where the length of the linear portion of the intermediate portion 12 or 13 is bisected.

As shown in FIGS. 2, 3, and 7 to 10, the inclined portions of the both end portions of the intermediate portions 12, 13 of the plug contacts 10 are drawn out obliquely downward from the front side faces of the plugs 3A, 3B. As shown in FIG. 11, therefore, the front portions of the cover members 5A, 5B which are lowered by the swing of the cover members 5A, 5B in pulling of the plugs 3A, 3B in the plug fitting recesses 41 of the sockets 4A, 4B with setting the cover members 5A, 5B as a fulcrum do not interfere with the plug contacts 10 drawn out from the front side faces of the plugs 3A, 3B, and hence it is possible to prevent the plug contacts 10 from being bent and damaged.

As shown in FIGS. 1 to 5, the plug contacts 10 are formed into two kinds in which only the level positions of the linear portions are differentiated by changing the lengths of the inclined portions of the both end portions in the intermediate portions 12, 13. The plug contacts 10 having the intermediate portion 12 in which the level of the linear portion is high, those having the intermediate portion 13 in which the level of the linear portion is low are alternately arranged. Therefore, the linear portions of the intermediate portions 12, 13 of the plug contacts 10 are positionally shifted from each other in the thickness direction (the vertical direction) of the contacts, so that predetermined gaps 14 in a side view are ensured in the linear portions of the intermediate portions 12, 13 of the plug contacts 10. The both ends of the gaps 14 are closed by the inclined portions of the both end portions of the intermediate portions 13 in which the level of the linear portion is low.

As shown in FIGS. 1 to 4, an insulating member 7 is disposed in the intermediate portions 12, 13 of the plug contacts 10 between the plug 3A and the other plug 3B. A predetermined gap is ensured between the adjacent plug contacts 10 by the insulating member 7, so that the plug contacts are prevented from contacting with each other. The insulating member 7 is made of an insulating material (synthetic resin), and has an approximately rectangular parallelepiped shape that is laterally elongated. Plural thin contact grooves 70 through which the intermediate portions 12, 13 of the plug contacts 10 are to be passed at a predetermined pitch with forming predetermined intervals are alternately distributively disposed in the upper and lower faces of the insulating member 7. The linear portions of the intermediate portions 12 of the plug contacts 10 having the intermediate portion 12 in which the level of the linear portion is high are fitted from the upper face side into and passed in the anteroposterior direction through the contact grooves 70 disposed in the upper face of the insulating member 7, and those of the intermediate portions 13 of the plug contacts 10 having the intermediate portion 13 in which the level of the linear portion is low are fitted from the lower face side into and passed in the anteroposterior direction through the contact grooves 70 disposed in the lower face of the insulating member 7. A plate-like core part 71 that is the insulating member 7 the thickness of which is reduced by the contact grooves 70 is interposed in the thickness direction (the vertical direction) of the core part between the linear portions of the intermediate portions 12 of the plug contacts 10 having the intermediate portion 12 in which the level of the linear portion is high, and those of the intermediate portions 13 of the plug contacts 10 having the intermediate portion 13 in which the level of the linear portion is low, and the insulating member 7 is interposed between the intermediate portions 12, 13 of the plug contacts 10 so as to be movable in the contact length direction, whereby a predetermined gap is ensured between the adjacent plug contacts 10 by partition walls 72 which are the insulating member 7 between the contact grooves 70, so that the plug contacts are prevented from contacting with each other.

The adjacent plug contacts 10 are prevented: from contacting with each other by the insulating member 7 which is simply interposed between the intermediate portions 12, 13 of the plug contacts 10 so as to be movable in the contact length direction, and which is not fixed. Therefore, the attachment position and number of the insulating member 7 can be easily changed, and can readily cope with the connecting configuration such as the connecting distance between the boards 2A, 2B and the connecting direction thereof. The predetermined gaps 14 in a side view are ensured from the beginning between the linear portions of the intermediate portions 12 of the plug contacts 10 which are passed through the contact grooves 70 disposed in the upper face of the insulating member 7, and those of the intermediate portions 13 of the plug contacts 10 which are passed through the contact grooves 70 disposed in the lower face of the insulating member 7. Therefore, interposing of the insulating member 7 can be easily performed. When the attachment position or number of the insulating member 7 is changed, furthermore, a deforming force is not applied to the plug contacts 10, and hence plastic deformation can be prevented from occurring.

In the embodiment, the board connector 1 used for electrically connecting the board 2A and other board 2B which are placed in parallel has been described. Alternatively, the plug contacts 10 may be bent in the linear portions of the intermediate portions 12, 13, thereby enabling also stepped or angled boards to be connected to each other. The sockets 4A, 4B of the surface-mount type have been described. Alternatively, sockets of the pin-mount type may be used.

What is claimed is:

1. A board connector comprising: a plug in which one-end sides of plug contacts configured by plural thin conductors are fixed in parallel to a plug body made of an insulating material; a socket in which a plug fitting recess is disposed in a socket body made of an insulating material, socket contacts configured by plural thin conductors are fixed in parallel to said socket body, and movable contact pieces that are disposed in one-end sides of said socket contacts, and that are elastically displaceable are projected in said plug fitting recess; and a cover member which is attached to said plug to cover said plug and said socket that are in a fitting state.

2. A board connector comprising: a plug in which one-end sides of plug contacts configured by plural thin conductors are fixed in parallel to a plug body made of an insulating material; a socket in which a plug fitting recess is disposed in a socket body made of an insulating material, socket contacts configured by plural thin conductors are fixed in parallel to said socket body, and movable contact pieces that are disposed in one-end sides of said socket contacts, and that are elastically displaceable are projected in said plug fitting recess; and a cover member which is swingably attached to said plug via a fulcrum shaft to cover said plug and said socket that are in a fitting state.

3. A board connector comprising: a plug in which one-end sides of plug contacts configured by plural thin conductors are fixed in parallel to a plug body made of an insulating material; a socket in which a plug fitting recess is disposed in a socket body made of an insulating material, socket contacts configured by plural thin conductors are fixed in parallel to said socket body, and movable contact pieces that are disposed in one-end sides of said socket contacts, and that are elastically displaceable are projected in said plug fitting recess; a cover member which is swingably attached to said plug via a fulcrum shaft to cover said plug and said socket that are in a fitting state; and a protrusion which is disposed in one of said plug and said cover member, and which causes an end portion to continuously butt against another one of said plug and said cover member from one end to another end.

4. A board connector comprising: a plug in which one-end sides of plug contacts configured by plural thin conductors are fixed in parallel to a plug body made of an insulating material; a socket in which a plug fitting recess is disposed in a socket body made of an insulating material, socket contacts configured by plural thin conductors are fixed in parallel to said socket body, and movable contact pieces that are disposed in one-end sides of said socket contacts, and that are elastically displaceable are projected in said plug fitting recess; a cover member which is swingably attached to said plug via a fulcrum shaft to cover said plug and said socket that are in a fitting state; and engaging means for, when said plug and said socket are fitted to each other, fixing said cover member to said socket.

5. A board connector comprising: a plug in which one-end sides of plug contacts configured by plural thin conductors are fixed in parallel to a plug body made of an insulating material; a socket in which a plug fitting recess is disposed in a socket body made of an insulating material, socket contacts configured by plural thin conductors are fixed in parallel to said socket body, and movable contact pieces that are disposed in one-end sides of said socket contacts, and that are elastically displaceable are projected in said plug fitting recess; a cover member which is swingably attached to said plug via a fulcrum shaft to cover said plug and said socket that are in a fitting state; and joining portions which are disposed in said socket and said cover member, and which, when said plug and said socket are fitted to each other, are joined to each other in a front side with respect to said fulcrum shaft, said plug being pulled up by swinging said cover member with setting said joining portion with said socket as a fulcrum.

6. A board connector comprising: a plug in which one-end sides of plug contacts configured by plural thin conductors are fixed in parallel to a plug body made of an insulating material; a socket in which a plug fitting recess is disposed in a socket body made of an insulating material, socket contacts configured by plural thin conductors are fixed in parallel to said socket body, and movable contact pieces that are disposed in one-end sides of said socket contacts, and that are elastically displaceable are projected in said plug fitting recess; a cover member which is swingably attached to said plug via a fulcrum shaft to cover said plug and said socket that are in a fitting state; a protrusion which is disposed in one of said plug and said cover member, and which causes an end portion to continuously butt against another one of said plug and said cover member from one end to another end; and engaging means for, when said plug and said socket are fitted to each other, fixing said cover member to said socket.

7. A board connector comprising: a plug in which one-end sides of plug contacts configured by plural thin conductors are fixed in parallel to a plug body made of an insulating material; a socket in which a plug fitting recess is disposed in a socket body made of an insulating material, socket contacts configured by plural thin conductors are fixed in parallel to said socket body, and movable contact pieces that are disposed in one-end sides of said socket contacts, and that are elastically displaceable are projected in said plug fitting recess; a cover member which is swingably attached to said plug via a fulcrum shaft to cover said plug and said socket that are in a fitting state; a protrusion which is disposed in one of said plug and said cover member, and which causes an end portion to continuously butt against another one of said plug and said cover member from one end to another end; and joining portions which are disposed in said socket and said cover member, and which, when said plug and said socket are fitted to each other, are joined to each other in a front side with respect to said fulcrum shaft, said plug being pulled up by swinging said cover member with setting said joining portion with said socket as a fulcrum.

8. A board connector comprising: a plug in which one-end sides of plug contacts configured by plural thin conductors are fixed in parallel to a plug body made of an insulating material; a socket in which a plug fitting recess is disposed in a socket body made of an insulating material, socket contacts configured by plural thin conductors are fixed in parallel to said socket body, and movable contact pieces that are disposed in one-end sides of said socket contacts, and that are elastically displaceable are projected in said plug fitting recess; a cover member which is swingably attached to said plug via a fulcrum shaft to cover said plug and said socket that are in a fitting state; a protrusion which is disposed in one of said plug and said cover member, and which causes an end portion to continuously butt against another one of said plug and said cover member from one end to another end; engaging means for, when said plug and said socket are fitted to each other, fixing said cover member to said socket; and joining portions which are disposed in said socket and said cover member, and which, when said plug and said socket are fitted to each other, are joined to each other in a front side with respect to said fulcrum shaft, said plug being pulled up by swinging said cover member with setting said joining portion with said socket as a fulcrum.

9. A board connector according to claim 1, wherein, in addition to said plug, said socket, and said cover member constituting said board connector, said board connector further comprises another plug, another socket, and another cover member constituting another board connector having a same structure as said board connector, other-end sides of said plug contacts are fixed in parallel to a plug body of said other plug, said socket is mounted on a board, said other socket is mounted on another board, and said boards are electrically connected to each other by said board connector and said other board connector.

10. A board connector according to claim 2, wherein, in addition to said plug, said socket, and said cover member constituting said board connector, said board connector further comprises another plug, another socket, and another cover member constituting another board connector having a same structure as said board connector, other-end sides of said plug contacts are fixed in parallel to a plug body of said other plug, said socket is mounted on a board, said other socket is mounted on another board, and said boards are electrically connected to each other by said board connector and said other board connector.

11. A board connector according to claim 3, wherein, in addition to said plug, said socket, and said cover member constituting said board connector, said board connector further comprises another plug, another socket, and another cover member constituting another board connector having a same structure as said board connector, other-end sides of said plug contacts are fixed in parallel to a plug body of said other plug, said socket is mounted on a board, said other socket is mounted on another board, and said boards are electrically connected to each other by said board connector and said other board connector.

12. A board connector according to claim 4, wherein, in addition to said plug, said socket, and said cover member constituting said board connector, said board connector further comprises another plug, another socket, and another cover member constituting another board connector having a same structure as said board connector, other-end sides of said plug contacts are fixed in parallel to a plug body of said other plug, said socket is mounted on a board, said other socket is mounted on another board, and said boards are electrically connected to each other by said board connector and said other board connector.

13. A board connector according to claim 5, wherein, in addition to said plug, said socket, and said cover member constituting said board connector, said board connector further comprises another plug, another socket, and another cover member constituting another board connector having a same structure as said board connector, other-end sides of said plug contacts are fixed in parallel to a plug body of said other plug, said socket is mounted on a board, said other socket is mounted on another board, and said boards are electrically connected to each other by said board connector and said other board connector.

14. A board connector according to claim 6, wherein, in addition to said plug, said socket, and said cover member constituting said board connector, said board connector further comprises another plug, another socket, and another cover member constituting another board connector having a same structure as said board connector, other-end sides of said plug contacts are fixed in parallel to a plug body of said other plug, said socket is mounted on a board, said other socket is mounted on another board, and said boards are electrically connected to each other by said board connector and said other board connector.

15. A board connector according to claim 7, wherein, in addition to said plug, said socket, and said cover member constituting said board connector, said board connector further comprises another plug, another socket, and another cover member constituting another board connector having a same structure as said board connector, other-end sides of said plug contacts are fixed in parallel to a plug body of said other plug, said socket is mounted on a board, said other socket is mounted on another board, and said boards are electrically connected to each other by said board connector and said other board connector.

16. A board connector according to claim 8, wherein, in addition to said plug, said socket, and said cover member constituting said board connector, said board connector further comprises another plug, another socket, and another cover member constituting another board connector having a same structure as said board connector, other-end sides of said plug contacts are fixed in parallel to a plug body of said other plug, said socket is mounted on a board, said other socket is mounted on another board, and said boards are electrically connected to each other by said board connector and said other board connector.

17. A board connector according to claim 9, wherein said board connector further comprises an insulating member made of an insulating material, plural thin contact grooves through which plug contacts between said plug and said other plug are to be passed are alternately disposed in one and other faces of said insulating member, and said insulating member is pressingly held in a movable manner by said plug contacts passed through said contact grooves disposed in said one face of said insulating member, and said plug contacts passed through said contact grooves disposed in said other face of said insulating member.

18. A board connector according to claim 10, wherein said board connector further comprises an insulating member made of an insulating material, plural thin contact grooves through which plug contacts between said plug and said other plug are to be passed are alternately disposed in one and other faces of said insulating member, and said insulating member is pressingly held in a movable manner by said plug contacts passed through said contact grooves disposed in said one face of said insulating member, and said plug contacts passed through said contact grooves disposed in said other face of said insulating member.

19. A board connector according to claim 11, wherein said board connector further comprises an insulating member made of an insulating material, plural thin contact grooves through which plug contacts between said plug and said other plug are to be passed are alternately disposed in one and other faces of said insulating member, and said insulating member is pressingly held in a movable manner by said plug contacts passed through said contact grooves disposed in said one face of said insulating member, and said plug contacts passed through said contact grooves disposed in said other face of said insulating member.

20. A board connector according to claim 12, wherein said board connector further comprises an insulating member made of an insulating material, plural thin contact grooves through which plug contacts between said plug and said other plug are to be passed are alternately disposed in one and other faces of said insulating member, and said insulating member is pressingly held in a movable manner by said plug contacts passed through said contact grooves disposed in said one face of said insulating member, and said plug contacts passed through said contact grooves disposed in said other face of said insulating member.

21. A board connector according to claim 13, wherein said board connector further comprises an insulating member made of an insulating material, plural thin contact grooves through which plug contacts between said plug and said other plug are to be passed are alternately disposed in one and other faces of said insulating member, and said insulating member is pressingly held in a movable manner by said plug contacts passed through said contact grooves disposed in said one face of said insulating member, and said plug contacts passed through said contact grooves disposed in said other face of said insulating member.

22. A board connector according to claim 14, wherein said board connector further comprises an insulating member made of an insulating material, plural thin contact grooves through which plug contacts between said plug and said other plug are to be passed are alternately disposed in one and other faces of said insulating member, and said insulating member is pressingly held in a movable manner by said plug contacts passed through said contact grooves disposed in said one face of said insulating member, and said plug contacts passed through said contact grooves disposed in said other face of said insulating member.

23. A board connector according to claim 15, wherein said board connector further comprises an insulating member made of an insulating material, plural thin contact grooves through which plug contacts between said plug and said other plug are to be passed are alternately disposed in one and other faces of said insulating member, and said insulating member is pressingly held in a movable manner by said plug contacts passed through said contact grooves disposed in said one face of said insulating member, and said plug contacts passed through said contact grooves disposed in said other face of said insulating member.

24. A board connector according to claim 16, wherein said board connector further comprises an insulating member made of an insulating material, plural thin contact grooves through which plug contacts between said plug and said other plug are to be passed are alternately disposed in one and other faces of said insulating member, and said insulating member is pressingly held in a movable manner by said plug contacts passed through said contact grooves disposed in said one face of said insulating member, and said plug contacts passed through said contact grooves disposed in said other face of said insulating member.

* * * * *